US012366423B2

(12) United States Patent
Wood et al.

(10) Patent No.: US 12,366,423 B2
(45) Date of Patent: Jul. 22, 2025

(54) FUEL POWERED PAINTBALL MARKER

(71) Applicant: War Machine, Inc., Taylors, SC (US)

(72) Inventors: Michael Wood, Taylors, SC (US); Chris Vandenberghe, Taylors, SC (US)

(73) Assignee: War Machine, Inc., Taylors, SC (US)

( * ) Notice: Subject to any disclaimer, the term of this patent is extended or adjusted under 35 U.S.C. 154(b) by 92 days.

(21) Appl. No.: 18/479,700

(22) Filed: Oct. 2, 2023

(65) Prior Publication Data

US 2025/0109917 A1 Apr. 3, 2025

(51) Int. Cl.
*F41A 1/04* (2006.01)

(52) U.S. Cl.
CPC ..... *F41A 1/04* (2013.01)

(58) Field of Classification Search
CPC ..... F41A 1/04; F41A 1/00
USPC ..... 89/7
See application file for complete search history.

(56) References Cited

U.S. PATENT DOCUMENTS

| | | | | |
|---|---|---|---|---|
| 7,665,396 | B1 * | 2/2010 | Tippmann, Jr. | B25C 1/08 89/7 |
| 8,015,907 | B2 * | 9/2011 | Tippmann, Sr. | F41B 11/721 89/7 |
| 8,826,792 | B1 * | 9/2014 | Granger | F41A 1/04 89/7 |
| 9,222,737 | B1 * | 12/2015 | Lund | F41A 1/04 |
| 2004/0144012 | A1 * | 7/2004 | Adams | F41A 1/04 42/106 |
| 2010/0212481 | A1 * | 8/2010 | Koth | F41A 1/00 124/75 |

* cited by examiner

*Primary Examiner* — John Cooper
(74) *Attorney, Agent, or Firm* — Kim and Lahey Law Firm, LLC; Douglas William Kim

(57) ABSTRACT

A fuel powered paint marker having a first stage and a second stage comprising: a housing; a combustion chamber; a piston; a compression chamber; a fuel system; an oxidizing system; an oxidizing agent; a fuel assembly included in the fuel system; a separation assembly included in the fuel system and separating the oxidizing agent from the fuel assembly in the first stage; a bolt drive system; a fuel nozzle included in the fuel system for injecting fuel into the combustion chamber during the second stage; and, an ignition for igniting the fuel and oxidating agent in the combustion chamber driving the piston forward and compressing a gas in the compression chamber thereby ejecting a projectile wherein the fuel and oxidizing agent are separated during the first stage and mixed in the combustion chamber.

20 Claims, 7 Drawing Sheets

FUEL POWERED PAINTBALL MARKER

BACKGROUND OF THE INVENTION

1) Field of the Invention

This assembly is directed to a fuel powered paintball marker using a combustion fuel, oxidation agent and ambient air wherein the fuel can be separated from the ambient air and oxidation agent in a first stage and combined in a second stage to increase safety and provide for a high cycle rate for ejecting projectiles. In certain embodiments, the assembly can be a paintball marker as well as a method and assembly to fire paintballs, or other like projectiles using a combustible fuel mixture to create compressed gas.

2) Description of the Related Art

The state of the art for firing a projectile such as a frangible projectile like a paintball uses a compressed gas source. Traditionally, the compressed gas is released into a chamber that uses the expansion of the compressed gas to eject a projectile from a barrel. The gases used are typically carbon dioxide and air.

Paintball can be a competitive team sport allowing team members from one team to eliminate players from another team by hitting them with paintballs. The paintballs can be spherical dye-filled capsules designed to break upon impact releasing the paint and marking the target. These projectiles are typically fired from low-energy compressed air platforms and are derived from paintball markers originally designed for marking trees, cattle, and other objects.

As the activity evolved into the recreation space, formal sporting levels with organized competition were created and can include major tournaments, professional teams, and players and trophies, prizes and "bragging rights." Game formats can have goals which can vary, but include capture the flag, elimination, defending or attacking a particular point or area, or capturing objects of interest hidden in the playing area.

The traditional platforms for paintball markers are limited due to air resistance and gravity. A paintball can accelerate to the maximum legal muzzle velocity limit of 300 fps (feet per second) has a maximum range of about 120 feet and an effective range (e.g., the range in which it has enough kinetic energy to break the paintball on a human body) of around 60 feet. To reach this speed and range without prematurely breaking the paintball, traditional markers utilize compressed gases as propellants.

According to the Ideal Gas Law, one of the basic laws of thermodynamics, a pressurized gas expands uniformly until its pressure is equal to that of the surrounding gases. Paintball markers take advantage of this law by using a canister similar to tanks used by scuba divers and firemen to store a high-pressure gas. The canister attaches to the marker platform and can include a pin that opens the valve in the canister to regulate gas flow into the marker's main gas chamber. A valve can connect the gas chamber to the breech where the paintball is held. When the marker is in an unfired position, the valve can be seated to prevent the gas in the chamber from escaping. When the trigger is pulled, a seal is pushed forward, briefly opening the valve to allow a short burst of compressed gas to expand through the valve and into the breech thereby launching a paintball. When the seal is opened, the sudden difference in pressure from one side of the paintball (in the action) to the other side (in the barrel) causes the high-pressure gas to exert a force on the paintball, pushing it forward as the gas expands outward through the barrel.

For mechanical paintball markers, there are two components that determine the marker's practical rate of fire. These are the trigger and the sear. The trigger's function is generally understood. The sear is typically a small lever controlled by the trigger that holds the hammer back. When the trigger is pulled, the sear is pivoted until it releases the lug on the hammer. These designs can cycle at about 20 to 40 bps (balls per second). However, the actual rate is limited by the force exerted on the trigger by the user which is typically under a pound of pressure to actuate the sear and release the hammer which reduces the practical rate of fire to only around 10 bps.

It would be advantageous to have a paintball marker that can achieve a practical rate of fire in excess of 10 bps.

The development of electropneumatic markers seeks to lighten the trigger pull to provide for higher rates of fire. Instead of using the finger's strength to trip the sear and release the hammer, an electropneumatic marker uses the strength of pressurized air to drive the hammer and in so doing reduces the sear to a microswitch. As a result, the pressure that needs to be applied to the trigger to activate the firing cycle is reduced from the 16 oz previously necessary with mechanical triggers to as little as 1 oz. This design allows for "walking" the trigger which is a method of tapping the trigger alternately with the pointer and middle fingers allowing the player to achieve rates of fire in excess of 20 bps (using two fingers) on an electronic marker.

It would be advantageous to have a platform allowing fire rates to exceed 10 bps for single trigger pull and exceed 20 bps with the walking technique.

When reviewing paintball markers, the number of projectiles that can be fired without replacement of the power source is an important feature. Typically, about 1000 shots can be fired for every kilogram of CO2 in a cylinder. Therefore, a 5-kilogram cylinder can provide around 1500 shots. Typical cylinder sizes range from 12 grams to 36 ounces. From one vendor, a 20-ounce tank is 11.57×3.98×3.27 inches making it difficult to run, hide, turn corners, carry and otherwise effectively use in paintball sports.

It would be desirable to increase the number of shots in a given tank size so that a small tank can be used for many shots without having to carry tanks and cylinders that are about a foot long.

BRIEF SUMMARY OF THE INVENTION

The above objectives are accomplished by providing, a fuel powered paint marker which can have a first stage and a second stage comprising: a housing that can have a cavity defined in the housing; a piston that can be received in the housing; a combustion chamber defined by the housing and a first side of the piston; a compression chamber that is defined by the housing and a second side of the piston; a fuel system that is carried by the housing and in fluid communications with the combustion chamber; an oxidizing system that is included in the fuel system that has an oxidizing input for receiving an oxidizing agent wherein the oxidizing agent enters the oxidizing system during the first stage; an oxidizing output that is included in the oxidizing system; a fuel assembly that is included in the fuel system having a fuel input wherein fuel enters the fuel assembly during the first stage; a separation assembly that is included in the fuel system and separates the oxidizing agent from the fuel assembly in the first stage; a bolt drive system that is carried by the housing that has a bolt piston, bolt drive rod and a bolt; a first oxidizing input that can be included in the bolt drive system in fluid and is in communication with the oxidizing output wherein the oxidizing agent is inserted into a bolt piston chamber driving the bolt piston forward thereby closing the bolt; a second oxidizing input that is included in the bolt drive system in fluid communication with the oxidizing output wherein the oxidizing agent is inserted into a bolt reservoir chamber during the first stage and the oxidizing agent is injected into the combustion chamber during the second stage; a fuel nozzle included in the fuel system which injects fuel into the combustion chamber during the second stage; and, an ignition for igniting the fuel and oxidizing agent in the combustion chamber driving the piston forward and compressing a gas in the compression chamber thereby ejecting a projectile.

The separation assembly can be a solenoid and can include a controller in electrical communications with the solenoid that when actuated transitions the solenoid from a first position to a second position. A trigger can be operatively associated with the controller so that when the trigger is activated, the controller transitions the solenoid.

A trigger can be in contact with a switch included on the controller for actuating the controller. A resilient member can be affixed to the piston at a first end and a piston housing at a second end and adapted to bias the piston in a rearward position. An exhaust opening can be defined in the housing adapted to allow combusted gas to escape the housing. The separation assembly can be adapted to allow the oxidizing agent to enter the combustion chamber during the second stage. An oxidizing agent source can be in fluid communications with the fuel assembly and can be adapted to deliver the oxidizing agent to the oxidizing system under pressure.

An ambient opening can be defined in the fuel system which is adapted to allow ambient air to enter the fuel system during the first stage. The fuel oxidizing agent and ambient air can enter the combustion chamber during the first stage and ignite during the second stage. A first stage and a second stage can be included. A housing that has a cavity defined in the housing and a piston received in the housing can be included. The system can include a combustion chamber defined by the housing and a first side of the piston; a compression chamber that is defined by the housing and a second side of the piston; a fuel system can be carried by the housing and in fluid communications with the combustion chamber which is adapted to receive fuel from a fuel source during the first stage and inject the fuel into the combustion chamber during a second stage; an oxidizing system can be carried by the housing which is adapted for receiving an oxidizing agent from an oxidizing agent source wherein the oxidizing agent enters the combustion chamber during the first stage; a separation assembly can be carried by the housing and is adapted to separate the oxidizing agent from the fuel system during the first stage; a bolt drive system can be carried by the housing which has a bolt piston, bolt drive rod and a bolt and in fluid communications with the oxidizing system wherein the bolt drive system receives the oxidizing agent into a bolt reservoir chamber during the first stage and into a bolt piston chamber driving the bolt piston forward thereby closing the bolt during the second stage and injecting the oxidizing agent into the combustion chamber during the second stage; an ignition adapter to ignite the fuel and oxidizing agent in the combustion chamber can drive the piston forward and compresses the gas in the compression chamber thereby ejecting a projectile.

An ambient opening can be defined in the fuel system adapted to allow ambient air to enter the fuel system during the first stage. An exhaust opening can be defined in the housing that is adapted to allow combusted gas to escape the housing. A resilient member can be affixed to the piston at a first end and a piston housing at a second end and adapted to bias the piston in a rearward position. A fuel powered paint marker that has a first stage and a second stage which comprises: a housing having a combustion chamber and a compression chamber that is defined by the housing and a piston received in the housing; a fuel system that is carried by the housing and in fluid communications with the combustion chamber adapted to receive fuel from a fuel source during the first stage and inject the fuel into the combustion chamber during a second stage; an oxidizing system that is carried by the housing and adapted for receiving an oxidizing agent from an oxidizing agent source wherein the oxidizing agent enters the combustion chamber during the second stage; an ignition that ignites the fuel and oxidizing agent in the combustion chamber driving the piston forward and compresses a gas in the compression chamber thereby ejecting a projectile. An ignition for igniting the fuel and oxidizing agent in the combustion chamber driving the piston forward and compressing a gas in the compression chamber thereby ejecting a projectile.

A bolt drive system can be carried by the housing having a bolt piston and bolt drive rod and in fluid communications with the oxidizing system wherein the bolt drive system receives the oxidizing agent into a bolt reservoir chamber during the first stage and into a bolt piston chamber driving the bolt piston forward thereby closing a bolt connected to the bolt drive rod during the second stage. The system can be adapted to inject the oxidizing agent into the combustion chamber during the second stage. An ambient opening can be defined in the fuel system and adapted to allow ambient air to enter the fuel system during the first stage. A separation assembly can be carried by the housing and adapted to separate the oxidizing agent from the fuel system during the first stage.

BRIEF DESCRIPTION OF THE SEVERAL VIEWS OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

DETAILED DESCRIPTION OF THE INVENTION

Figure 1:
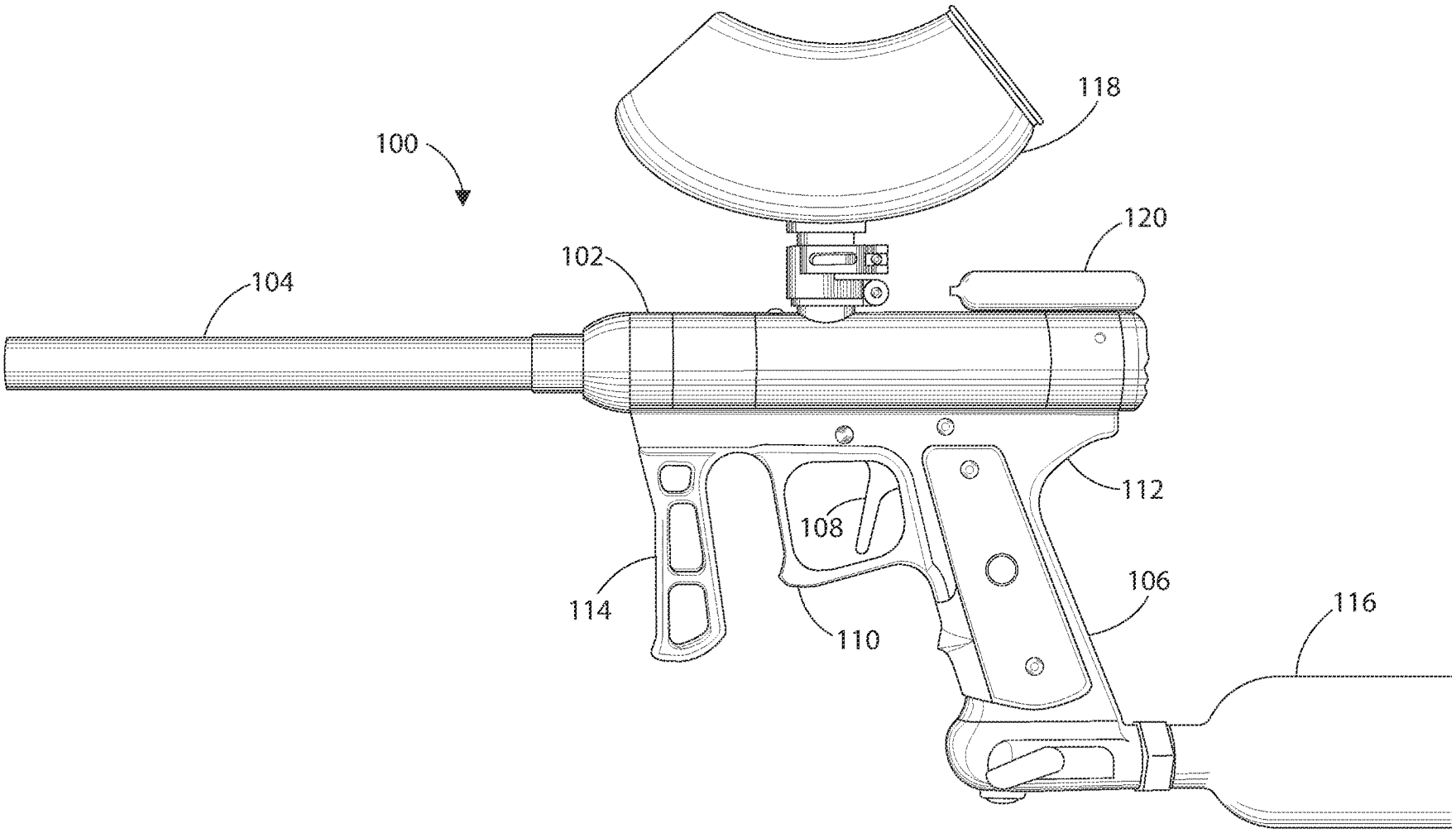
FIG. 1 is a side view of the assembly.

With reference to the drawings, the invention will now be described in more detail. Referring to FIG. 1, a paintball marker shown generally as 100 can include a housing 102 that can carry a barrel 104 and a grip 106. The housing can have a trigger 108 included that can be part of a trigger assembly. A trigger guard 110 can be connected to a frame 112 and can protect the trigger. The frame can be connected to or carry housing 102. The frame can include a foregrip 114 to provide additional support when holding the paintball marker. A fuel source 116 can be carried by the frame and can contain fuel. An oxidation agent source 120 can be carried by the frame and contain an oxidizing agent. A paintball hopper 118 can be removably attached to the frame and adapted to receive an inventory of paintballs.

Figure 2:
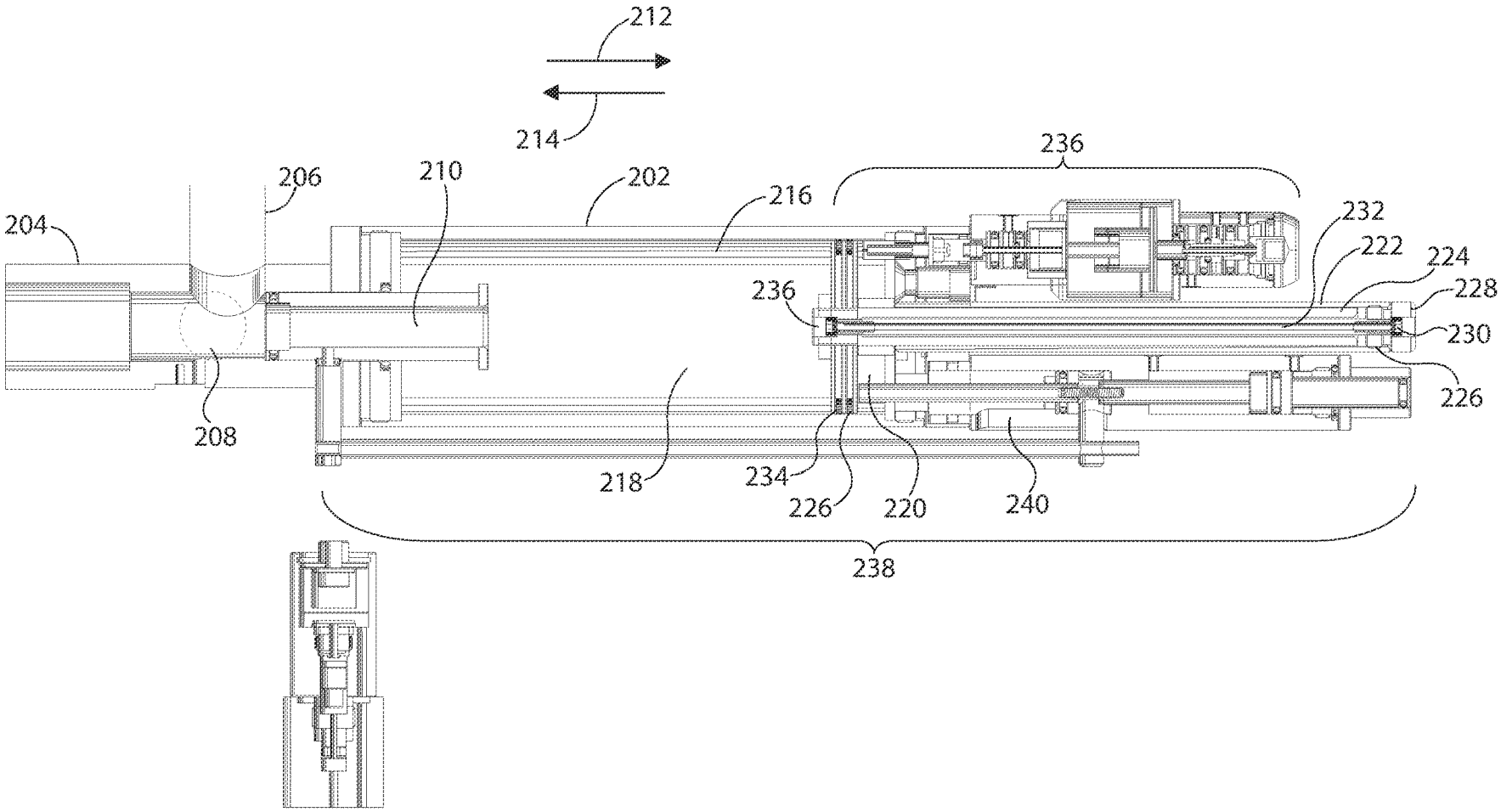
FIG. 2 is a cross section of aspects of the assembly.

Referring to FIG. 2, housing 202 is shown connected to barrel 204. The barrel can define a loading port 206 where paintballs can drop from the paintball hopper and enter chamber 208. A bolt 210, shown open, can be received in or against the chamber the chamber and can obstruct the loading port when in battery. The bolt can be in an open position when in the first stage and closed in a second stage. When in the first stage, paintballs can enter the chamber as the bolt 210 can be rearward in a direction shown as 212. When in the second stage, the paintball marker can be in a firing position so that the bolt is closed and in a forward position shown as 214.

The housing can include a main chamber 216 that can include a compression area chamber 218 and a combustion chamber 220. Piston 222 having a piston rod 224 and a piston head 226 can be received in the main chamber. The piston can be received in a piston tube 226. The piston tube can include a removeable piston tube cap 228 and a piston tension member 230. The piston tension member can be attached to one end of a resilient member 232 and the other end of the resilient member can be attached to the piston to bias the piston rearward 212. The piston head 226 can include a piston seal 234 such as an O-ring that can prevent fluid from being exchanged between the compression chamber and the combustion chamber. A piston cap 236 can secure the piston head 226 to the piston rod 224.

The housing can carry a fuel system 236 and a bolt drive system 238.

Ambient air can enter the oxidizing system through port 240 during the first stage. The ambient air can flow into the combustion chamber 220 to be mixed with the fuel and oxidating agent.

Figure 3:
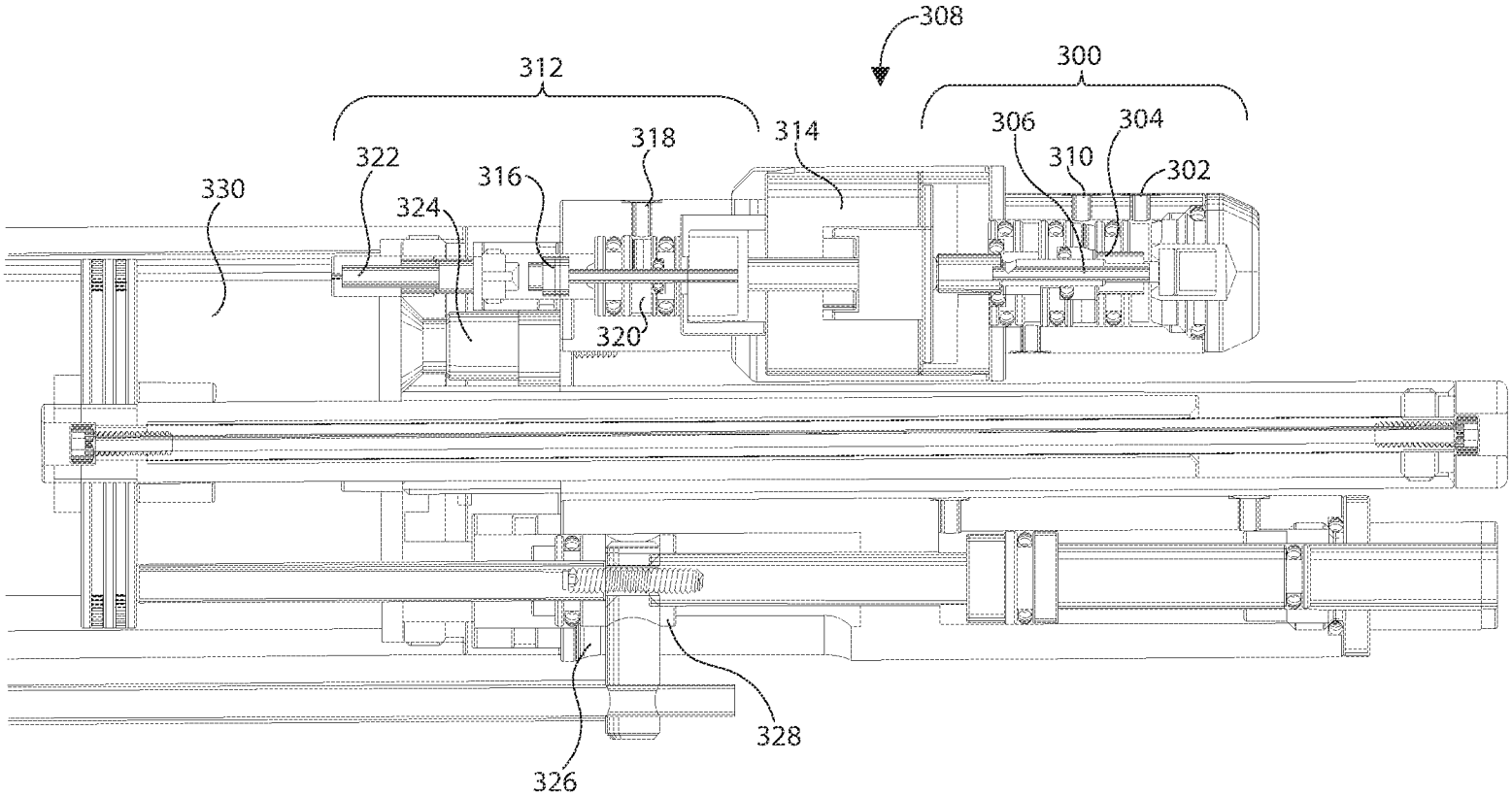
FIG. 3 is a cross section of aspects of the assembly.

Referring to FIG. 3 the paintball marker is shown in one embodiment transitioned from the first stage to the second stage. Referring to FIG. 3, the fuel system 308 can include an oxidizing system 300 that can have an oxidizing agent input 302 in fluid communications with the oxidation agent source. The oxidating agent can be $O_2$ or other fluid which supports combustion. An oxidation agent can enter the oxidizing system 300 through the oxidizing agent input 302 and can be contained in an oxidizing agent reservoir 304 and in a first stage. An oxidizing agent valve 306 is closed in the first stage preventing gate oxidating agent from entering a separation area in the oxidizing agent first stage. When the paintball maker is actuated, the oxidizing agent valve 306 opens allowing the oxidizing agent to exit an oxidizing agent output 310. The oxidizing agent output 310 can be in fluid communications with bolt drive system 238.

A fuel assembly 312 can be carried by the housing and can be separated from the oxidizing system by a separation assembly 314. The separation assembly can be a solenoid that can be in communications with a controller that can actuate the separation assembly. The separation assembly 314 can open and close the oxidizing agent valve as well as open and close a fuel valve 316. The controller can be actuated when the trigger is depressed. The trigger can actuate a switch which can actuate the controller.

The fuel assembly can include a fuel input 318 that allows fuel to enter a fuel reservoir 320 during the first stage. The fuel valve prevents the fuel from entering combustion chamber 330 during the first stage. When the separation assembly is actuated, the fuel is injected from fuel nozzle 322 into the combustion chamber. The fuel mixes with the oxidizing agent in the combustion chamber during the second stage and is then ignited using ignition 324. In the second stage, the fuel valve 322 is closed preventing the ignited gas from flowing into the fuel assembly. During the second stage, the transfer valve 328 closes preventing the mixture in the combustion chamber 330 from entering the bolt drive system. The combustion chamber, prior to firing can include fuel from the fuel system, oxidizing agent from the oxidizing system, air from ambient opening 326, and residual gas from prior cycles. Prior to firing, fuel valve 316 is closed and the transfer valve 328 is closed so that when the fuel, oxidizing agent, and air are ignited with ignition 324, the pressure form the combustion drives the piston forward, causes a fluid, such as air, in the compression chamber 318 to compress thereby ejecting the projectile. Pressure is created when the mixture in the combustion chamber combusts and the energy therefrom heats the gases within the chamber causing expansion of the gases.

When the combustion cycle reaches the exhaust stage, the gases in the combustion chamber 330 cool creating a vacuum which draws the piston head rearward 212. As the piston head draws rearward, the exhaust gas flows out through the ambient opening 240. The resilient member 232 assists with drawing the piston rearward. The piston head is stopped short of the rear of the combustion chamber leaving a volume of gas retained in the combustion chamber. The inclusion of this gas, and the introduction of ambient air, increases the efficacy of combustion induced expansion in the next cycle.

Figure 4:
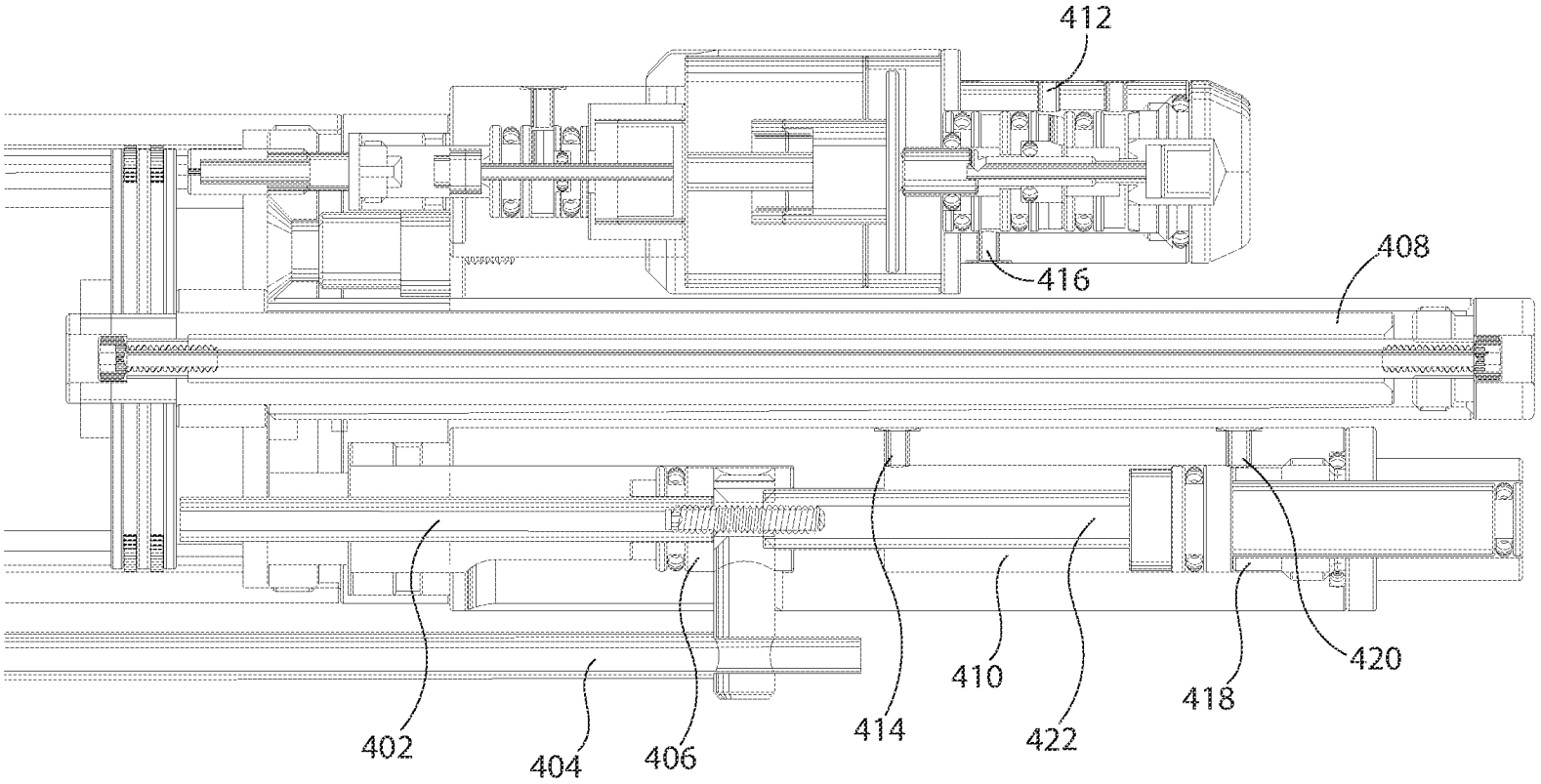
FIG. 4 is a cross section of aspects of the assembly.

Referring to FIG. 4, when the paintball marker transitions from the second stage back to the first stage, after ejecting the projectile, the push rod 402 is moved rearward 212 by the piston 408 moving rearward. Therefore, the drive rod 404 moves rearward, which is connected to the bolt, moves rearward, and opens the bolt. The transition valve 406 opens allowing exhaust gases to exit the paintball marker.

During the first stage, the oxidating agent is inserted into the oxidizing system. During the second stage, the oxidating agent exits the oxidizing system from a first oxidizing output 412 and flows into an oxidizing agent accumulator 410 through a first oxidizing input 414. The oxidating agent is held in the oxidizing agent accumulator until it is injected into the combustion chamber during the second stage. During the second stage, the oxidating agent exits the oxidizing system from a second oxidizing output 416 and flows into an oxidizing agent pressure area 418 through a second oxidizing input 420. The pressure from the oxidizing agent created in the oxidizing agent pressure area 418 drive the oxidizing agent piston 422 forward. This motion injects the oxidizing agent into the combustion chamber. This motion can also inject ambient air into the combustion chamber.

Figure 5:
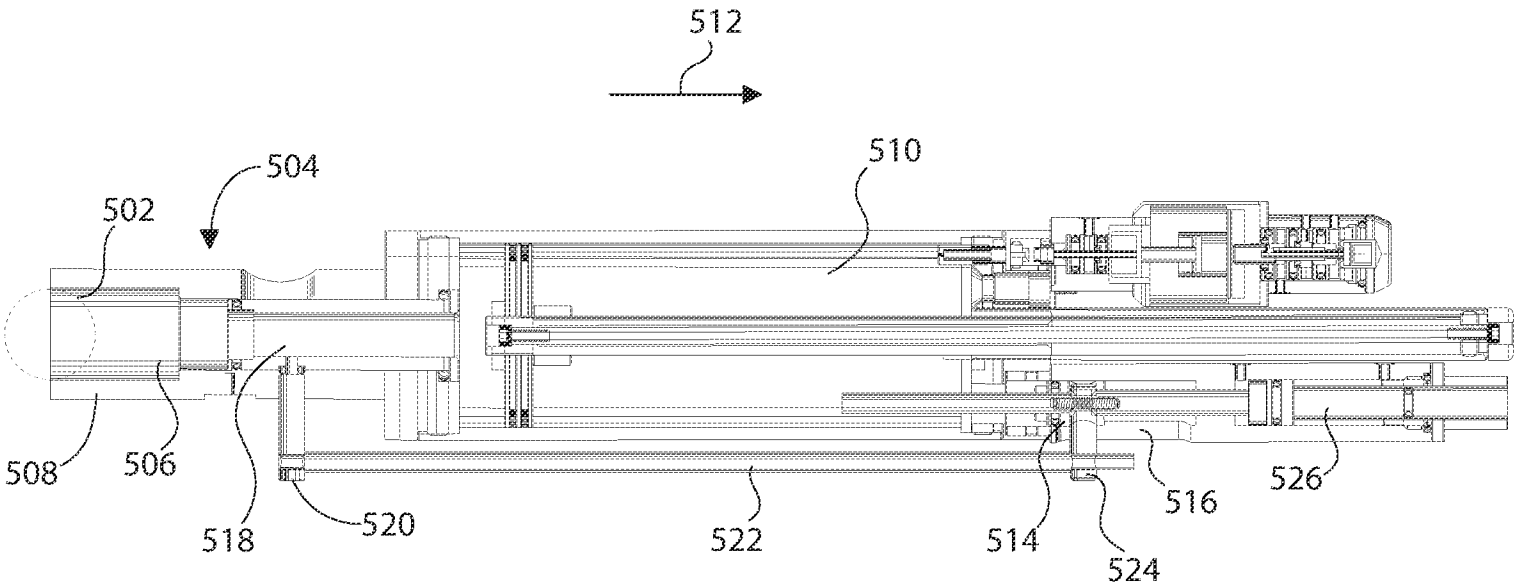
FIG. 5 is a cross section of aspects of the assembly.

Referring to FIG. 5, the paintball marker is shown to have just ejected a projectile 502 from chamber 504. The fluid, such as air, in the compression chamber have been compressed and is exiting or exits bore 506 of the barrel 508. The gases in the combustion chamber 510 cool creating a vacuum in this chamber which draws the piston rearward in a direction shown as 512. The transition valve 514 moves rearward allowing exhaust to escape the paintball maker through ambient opening 516. The bolt is connected to a first linkage 520 which is connected to a drive rod 522 which is connected to a second linkage 524 so that when the bolt piston 526 is moved rearward, the bolt 518 moves rearward opening the chamber.

Figure 6:
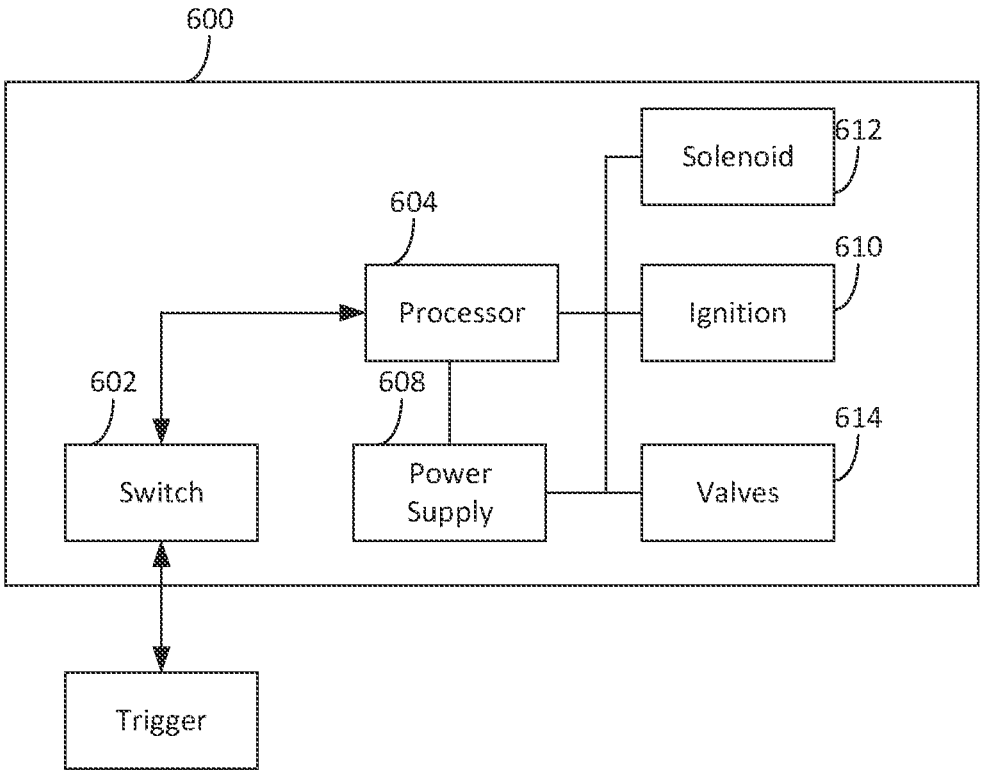
FIG. 6 is a schematic of aspects of the assembly; and,
FIG. 7 is a schematic of aspects of the assembly.

Referring to FIG. 6, the controller 600 shown having a switch 602 that can be actuated when the trigger is pulled.

The switch can be connected to processor 604 which can control the components. The controller can include power supply 608 that can power the controller, ignition 610, solenoid 612 and valves 614. The valves can include $O_2$ valve and fuel valve. Computer readable instructions included on the controller can provide for the timing and control of the various components. A sequence of events can be initiated with the actuation of the trigger.

Figure 7:
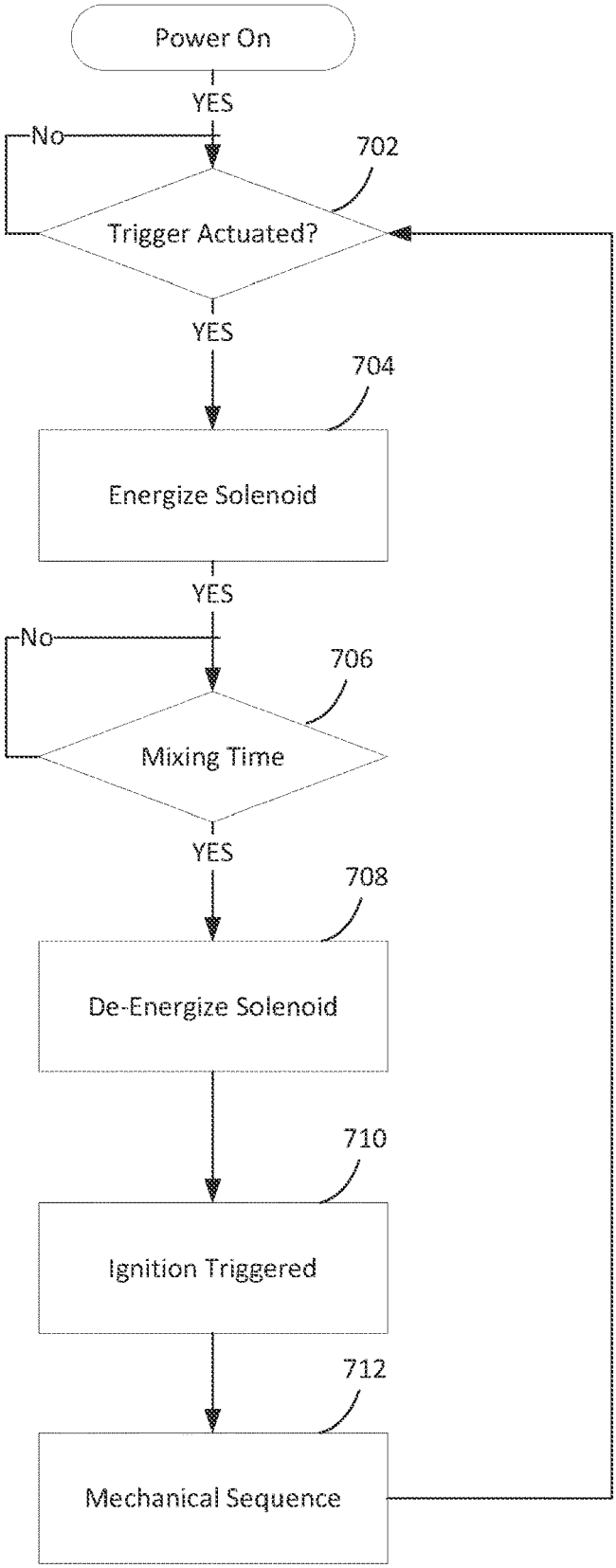

Referring to FIG. 7, the controller can include computer readable instructions, controller, or other assembly that wait for the trigger to be actuated and when the trigger is actuated at 702, the solenoid is energized at 704. When the solenoid is energized, a timer is started at 706 that allows for sufficient time to have air and fuel to mix and flow into the combustion chamber. The solenoid is then de-energizing solenoid at 708 which finishes mixing the air and fuel and pushes the mixture into the combustion chamber. This process with the air and fuel can occur prior to allowing $O_2$ to enter the combustion chamber through the oxidizing agent piston. The controller can activate the piston using the pressurized $O_2$ to move the piston into the firing position. The ignition can be triggered at 710 and a mechanical firing sequence initiated at 712. In one embodiment, the solenoid controls one or more valves that allow the fuel and air to mix and the O2 to enter the respective areas. In one embodiment, the valves can be controlled by the controller.

It is understood that the above descriptions and illustrations are intended to be illustrative and not restrictive. It is to be understood that changes and variations may be made without departing from the spirit or scope of the following claims. Other embodiments as well as many applications besides the examples provided will be apparent to those of skill in the art upon reading the above description. The scope of the invention should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. The omission in the following claims of any aspect of subject matter that is disclosed herein is not a disclaimer of such subject matter, nor should it be regarded that the inventor did not consider such subject matter to be part of the disclosed inventive subject matter.

What is claimed is:

1. A fuel powered paint marker having a first stage and a second stage comprising:

a housing having a cavity defined in the housing;

a piston received in the housing;

a combustion chamber defined by the housing and a first side of the piston;

a compression chamber defined by the housing and a second side of the piston;

a fuel system carried by the housing and in fluid communications with the combustion chamber;

an oxidizing system included in the fuel system having an oxidizing input for receiving an oxidizing agent wherein the oxidizing agent enters the oxidizing system during the first stage;

an oxidizing output included in the oxidizing system;

a fuel assembly included in the fuel system having a fuel input wherein fuel enters the fuel assembly during the first stage;

a separation assembly included in the fuel system and separating the oxidizing agent from the fuel assembly in the first stage;

a bolt drive system carried by the housing having a bolt piston, bolt drive rod and a bolt;

a first oxidizing input included in the bolt drive system in fluid communication with the oxidizing output wherein the oxidizing agent is inserted into a bolt piston chamber driving the bolt piston forward thereby closing the bolt;

a second oxidizing input included in the bolt drive system in fluid communication with the oxidizing output wherein the oxidizing agent is inserted into a bolt reservoir chamber during the first stage and the oxidizing agent is injected into the combustion chamber during the second stage;

a fuel nozzle included in the fuel system for injecting fuel into the combustion chamber during the second stage; and, an ignition for igniting the fuel and oxidizing agent in the combustion chamber driving the piston forward and compressing a gas in the compression chamber thereby ejecting a projectile.

2. The fuel powered paint marker of claim 1 wherein the separation assembly is a solenoid.

3. The fuel powered paint marker of claim 2 including a controller in electrical communications with the solenoid that when actuated transitions the solenoid from a first position to a second position.

4. The fuel powered paint marker of claim 3 including a trigger operatively associated with the controller so that when the trigger is activated, the controller transitions the solenoid.

5. The fuel powered paint marker of claim 4 including a trigger in contact with a switch included on the controller for actuating the controller.

6. The fuel powered paint marker of claim 1 including a resilient member affixed to the piston at a first end and a piston housing at a second end and adapted to bias the piston in a rearward position.

7. The fuel powered paint marker of claim 1 including an exhaust opening defined in the housing adapted to allow combusted gas to escape the housing.

8. The fuel powered paint marker of claim 1 wherein the separation assembly adapted to allow the oxidizing agent to enter the combustion chamber during the second stage.

9. The fuel powered paint marker of claim 1 including an oxidizing agent source in fluid communications with the fuel assembly adapted to deliver the oxidizing agent to the oxidizing system under pressure.

10. The fuel powered paint marker of claim 1 including an ambient opening defined in the fuel system adapted to allow ambient air to enter the fuel system during the first stage.

11. The fuel powered paint marker of claim 10 wherein the fuel, oxidizing agent and ambient air enter the combustion chamber during the first stage and ignite during the second stage.

12. A fuel powered paint marker having a first stage and a second stage comprising:

a housing having a cavity defined in the housing and a piston received in the housing;

a combustion chamber defined by the housing and a first side of the piston;

a compression chamber defined by the housing and a second side of the piston;

a fuel system carried by the housing and in fluid communications with the combustion chamber adapted to receive fuel from a fuel source during the first stage and inject the fuel into the combustion chamber during a second stage;

an oxidizing system carried by the housing adapted for receiving an oxidizing agent from an oxidizing agent source wherein the oxidizing agent enters the combustion chamber during the first stage;

a separation assembly carried by the housing and adapted to separate the oxidizing agent from the fuel system during the first stage;

a bolt drive system carried by the housing having a bolt piston, bolt drive rod and a bolt and in fluid communications with the oxidizing system wherein the bolt drive system receives the oxidizing agent into a bolt reservoir chamber during the first stage and into a bolt piston chamber driving the bolt piston forward thereby closing the bolt during the second stage and injecting the oxidizing agent into the combustion chamber during the second stage;

an ignition for igniting the fuel and oxidizing agent in the combustion chamber driving the piston forward and compressing a gas in the compression chamber thereby ejecting a projectile.

13. The fuel powered paint marker of claim 12 including an ambient opening defined in the fuel system adapted to allow ambient air to enter the fuel system during the first stage.

14. The fuel powered paint marker of claim 12 including an exhaust opening defined in the housing adapted to allow combusted gas to escape the housing.

15. The fuel powered paint marker of claim 12 including a resilient member affixed to the piston at a first end and a piston housing at a second end and adapted to bias the piston in a rearward position.

16. A fuel powered paint marker having a first stage and a second stage comprising:

a housing having a combustion chamber and a compression chamber defined by the housing and a piston received in the housing;

a fuel system carried by the housing and in fluid communications with the combustion chamber adapted to receive fuel from a fuel source during the first stage and inject the fuel into the combustion chamber during a second stage;

an oxidizing system carried by the housing adapted for receiving an oxidizing agent from an oxidizing agent source wherein the oxidizing agent enters the combustion chamber during the second stage; and, an ignition for igniting the fuel and oxidizing agent in the combustion chamber driving the piston forward and compressing a gas in the compression chamber thereby ejecting a projectile.

17. The fuel powered paint marker of claim 16 having a bolt drive system carried by the housing having a bolt piston and bolt drive rod and in fluid communications with the oxidizing system wherein the bolt drive system receives the oxidizing agent into a bolt reservoir chamber during the first stage and into a bolt piston chamber driving the bolt piston forward thereby closing a bolt connected to the bolt drive rod during the second stage.

18. The fuel powered paint marker of claim 17 wherein the oxidizing system is adapted to inject the oxidizing agent into the combustion chamber during the second stage.

19. The fuel powered paint marker of claim 16 including an ambient opening defined in the fuel system adapted to allow ambient air to enter the fuel system during the first stage.

20. The fuel powered paint marker of claim 16 including a separation assembly carried by the housing and adapted to separate the oxidizing agent from the fuel system during the first stage.

* * * * *